US006518716B2

(12) United States Patent
Sasaki

(10) Patent No.: US 6,518,716 B2
(45) Date of Patent: Feb. 11, 2003

(54) BEAM DEFLECTION SYSTEM AND COLOR TUBE

(75) Inventor: Hiroyuki Sasaki, Yokohama (JP)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/841,870

(22) Filed: Apr. 25, 2001

(65) Prior Publication Data

US 2002/0011789 A1 Jan. 31, 2002

(30) Foreign Application Priority Data

Jun. 13, 2000 (JP) ..... 2000-177468

(51) Int. Cl.[7] ..... G09G 1/04
(52) U.S. Cl. ..... 315/364
(58) Field of Search ..... 315/364, 365, 315/368.11, 368.25, 368.27, 368.28

(56) References Cited

U.S. PATENT DOCUMENTS 4,719,391 A * 1/1988 Maruta ..... 315/368
6,265,836 B1 * 7/2001 Aoki ..... 315/370
6,285,141 B1 * 9/2001 Osawa ..... 315/368.28
6,304,044 B1 * 10/2001 Tagami et al. ..... 315/364
6,326,742 B1 * 12/2001 Iwassaki et al. ..... 315/370
6,326,745 B1 * 12/2001 Yokota ..... 315/400
6,346,769 B1 * 2/2002 Saito et al. ..... 313/440

* cited by examiner

*Primary Examiner*—Don Wong
*Assistant Examiner*—Minh Dieu A
(74) *Attorney, Agent, or Firm*—Darby & Darby

(57) ABSTRACT

An electron beam deflection system is positioned outside of a main body of a color tube having a neck, inside of which electron beams extend horizontally, and a display unit extend laterally from the neck for displaying images by means of electron beams scanned from the electron beams. The system includes a pair of vertically opposed horizontal deflection coils, a pair of horizontally opposed vertical deflection coils, and a pair of vertically opposed coils outside the neck, each coil including a correction coil in a diametric direction of the neck for generating a magnetic field in an opposite direction to the direction or correcting a YV aberration. Therefore, the electron beam deflection system according to the invention has an effect of providing a color tube of high quality owing to its capability of correcting a variety of chromatic aberration in a wide range with a simple construction.

17 Claims, 7 Drawing Sheets

BEAM DEFLECTION SYSTEM AND COLOR TUBE

BACKGROUND OF THE INVENTION

1. Field of the Invention

The present invention relates to a beam deflection system and a color tube, and in particular, to a beam deflection system capable of correcting chromatic aberration of image on a color tube.

2. Description of the Related Art

In general, an electronic tube for color image display (hereinafter, referred to as a "color tube") 100 comprises a main body 101 of the color tube including a neck 102 of a tube shape and a display unit 103, and a beam deflection system (hereinafter, referred to as a "deflection yoke") 104 allocated outside of the main body 101, as shown in FIG. 8.

Three electron guns 105, which generate three electron beams E corresponding to the image signals of three light colors red (R), green (G) and blue (B) inside of the neck 102, are arranged in horizontal direction in the color tube 100.

Fluorescent dots R, G, B are formed on a front surface of the display unit 103. A predetermined image is displayed by scanning the electron beam E of each image signal to the dots.

Meanwhile, a deflection yoke 104 is provided around the color tube from the neck 102 to the display unit 103 of the main body 103 for deflecting the progress of the electron beam E to vertical and horizontal directions.

As shown in FIG. 8, the deflection yoke 104 comprises a pair of horizontal deflection coils 106 vertically facing with each other in a tube shape to have a diameter coaxially extended from the neck 102 to the display unit 103 with the axial line P of the main body 101 of the color tube, a pair of vertical deflection coils 108 oppositely distanced from each other in a horizontal direction around an external periphery of a coil separator 107, on an internal surface of which the horizontal deflection coils 106 are mounted, and a ferrite core 109 of a ring shape surrounding the pair of vertical deflection coils 108.

The pair of horizontal deflection coil 106 of the deflection yoke 104 deflect the electron beams to a horizontal direction by providing the progress of the electron beams E with a vertical magnetic field, while the pair of vertical deflection coils 108 deflect the electron beams E to a vertical direction by providing the progress of the electron beams E with a horizontal magnetic field.

The coil separator 107 separates the horizontal deflection coils 106 from the vertical deflection coils 108, and supports those coils so that the positions thereof may not be biased.

Meanwhile, the ferrite core 109 is for enhancing magnetic flux formed in the progress of the electron beams E by the horizontal deflection coils 106 and the vertical deflection coils 108.

The horizontal and vertical deflection coils have two types. One is a bend type having a portion, in which a tip line of the neck is wound up in a radial direction in a rotational shape with respect to the axial line. The other is a bendless type having no wound-up portion.

As described above, the deflection yoke is coaxial with the axial line P of the main body of the color tube, while the three electron guns provided inside of the main body of the color tube has a construction such that a central electron gun for G is positioned on the axial line, and the other electron guns for B and R are positioned at both sides thereof.

When the three electron beams R, G, B are deflected against each deflection yoke in horizontal and vertical directions, the focusing angles of the electron beams for B and R, the original scanning position of which are out of the axial line, are varied and scanned to the dots that are out of a predetermined fluorescent dot, so that a chromatic aberration of images is generated.

The chromatic aberration as described above is classified into two cases: The first case is when convergence is misaligned in a horizontal direction (in an H direction) on B and R of the screen surface as shown in FIG. 10 (hereinafter, referred to as an "XH aberration"). The second case is when a vertical axis on B and R (a V axis) is inclined and crossed (hereinafter, referred to a "YH cross") as shown in FIG. 11.

Another case is when convergence is misaligned in a vertical direction (in a V direction) on B and R of the screen surface as shown in FIG. 12 (hereinafter, referred to as an "YV aberration).

Such kinds of chromatic aberration are attributable not only to the aberration between the electron beams and the axial line of the deflection yoke but also to an aberration or inclination, etc. of a bi-directional axis when the deflection yoke is mounted on the main body of the color tube. Thus, the chromatic aberration should be corrected by each color tube.

A method that has been conventionally considered especially to correct the YV aberration of the three kinds of chromatic aberration was to adjust the amount of current flowing in the vertical deflection coil or to adjust the horizontal magnetic field by means of a pair of correction coils facing in horizontal direction. In case of adjusting the amount of current flowing in the vertical deflection coil, however, a problem arises such that a deformation is enlarged due to inclination of the path of the central electron beam for G even if the YV aberration is corrected.

Another conventional method used for correction of the XH aberration was to mount iron flaps or correction flaps composed of ferrite core at left and right sides of the neck, and to move the positions thereof. When the correction coils are attached to the left and right sides of the neck to correct the YV aberration, the correction coils are interrupted by the correction flaps in view of their positions, and the effective scope of the correction flaps is limited. As a result, the correctional scope of the XH aberration becomes narrow.

Another method that has been suggested to avoid the interruption with the correction flaps for XH aberration was to install the correction coils for correction of the YV aberration at the neck in a vertical direction for the purpose of adjustment with a vertical magnetic field. However, the correction is limitedly achieved in any one case of either the YV aberration when the B image is outside and the R image is inside or the YV aberration when the R image is outside and the B image is inside to correspond to the connecting direction of the pair of coils. This means that the above method has a drawback of failing to satisfy the needs of bi-directionally correcting the YV aberration.

SUMMARY OF THE INVENTION

It is, therefore, an object of the present invention to provide an electron beam deflection system and a color tube using the same that can facilitate correction of the XH aberration with a simple structure and perfectly correct the bi-directional YV aberration.

To achieve the above objects, there is provided an electron beam deflection system positioned outside of a main body of a color tube having a neck, inside of which electron beams are arranged in a horizontal direction, and a display unit extended from the neck in its diameter for displaying images by means of electron beams scanned from the electron beams, the system comprising: a pair of horizontal deflection coils arranged to face with each other in a vertical direction; a pair of vertical deflection coils arranged to face with each other in a horizontal direction; and a pair of coils arranged to face with each other in a vertical direction outside of the neck, each of the coils including a correction coil in a diametric direction of the neck for generating a magnetic field in an opposite direction to the direction of correcting a YV aberration.

A first coil and a second coil constituting the correction coil are serially connected for generating magnetic fields in opposite directions. The phase of the connecting point between the first coil and the second coil is controlled by a variable resistor.

The first coil and the second coil constituting the correction coil comprise one or more coils on a core, and are serially connected at the respective ends thereof.

The present invention is characterized in that a pair of central beam correction coils are provided for correcting aberration of the electron beams from the central one of the electron guns, and each of the correction coil composed of the first and the second coils is provided inside of the respective correction coils of the central electron beam.

The present invention is also characterized by comprising an electron beam deflection system and a main body of a color tube.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENTS

Figure 1:
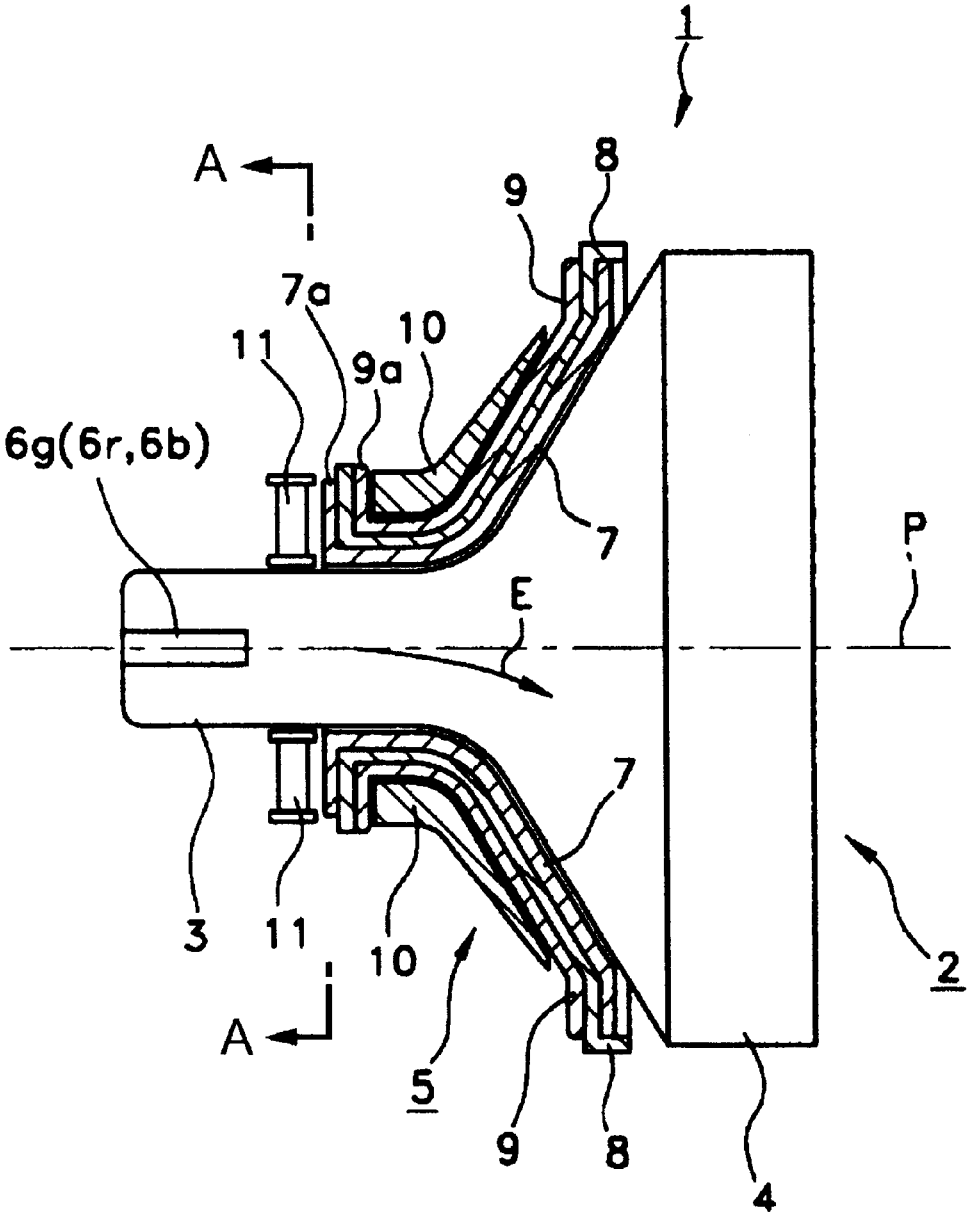
FIG. 1 is a longitudinal section view of a color tube illustrating a construction thereof according to the present invention.

Preferred embodiments of the present invention will now be described with reference to the accompanying drawings. In the following description, same drawing reference numerals are used for the same elements even in different drawings. The matters defined in the description are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
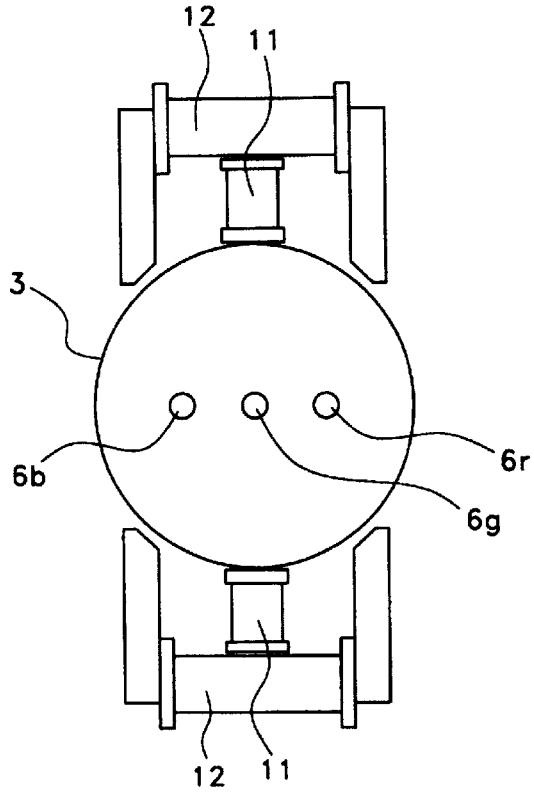
FIG. 2 is a longitudinal section view of line "A—A" in FIG. 1.

FIG. 1 is a longitudinal section view of a color tube illustrating a construction thereof according to the present invention. FIG. 2 is a longitudinal section view of line "A—A" in FIG. 1.

A color tube 1 is positioned throughout the periphery of a body thereof to encompass a main body 2, a neck, a display unit 4, and a deflection yoke 5 for deflecting a progress of the electron beams E in vertical and horizontal directions, as shown in FIG. 1.

The main body 2 of the color tube comprises the neck 3 and the display unit 4. As shown in FIG. 2, three electron guns 6*b*, 6*g*, 6*r* are lineally aligned inside of the neck 3 in a horizontal direction for scanning three electron beams E corresponding to each of the image signals R, G, B.

The deflection yoke 5 is of a tube shape having a diameter coaxially extended from the neck to the display unit 4 with an axial line P of the main body 2 as shown in FIG. 1. The deflection yoke 5 comprises: a pair of horizontal deflection coils 7 facing with each other in a vertical direction; a pair of vertical deflection coils 9 oppositely distanced from each other in a horizontal direction around an external periphery of a coil separator 8, on an internal surface of which the horizontal deflection coils 7 are mounted; and a ferrite core 10 of a ring shape provided around an external periphery of the vertical deflection coils 9. The deflection coil 5 is an example of employing a bend-type coil.

According to the embodiment of the deflection yoke 5 as described above, correction coils 11 for correcting a YV aberration are provided at a rear side of the bend portions 7*a*, 9*a*, in which a tip line of the neck is wound up in a radial direction in a rotational shape with respect to an axial line P.

The correction coils 11 for correcting the YV aberration comprise a pair of coils facing with each other in a vertical direction on an upper and lower portions of the neck 3 of the main body 2.

Accordingly, the correction coils 11 for correcting the YV aberration are to generate a magnetic field in an opposite direction to the diametric direction of the tube in accordance with the correcting direction of the YV aberration, i.e., in accordance with the correcting direction of the distortions whether the B image is distorted outward of the screen and the R image is distorted inward of the screen, or the B image is distorted inward of the screen and the R image is distorted outward of the screen.

The deflection yoke 5 according to the above embodiment comprises a pair of central beam correction coils 12 for correcting aberration of the electron beam E scanned from the central electron gun 6*g* for G among the three electron guns. The pair of central beam correction coils 12 is wound around a periphery of a core shaped "U" so as to be coaxial with the axial line P of the main body 2 from the neck 3 and to face with each other in a vertical direction.

Figure 3:
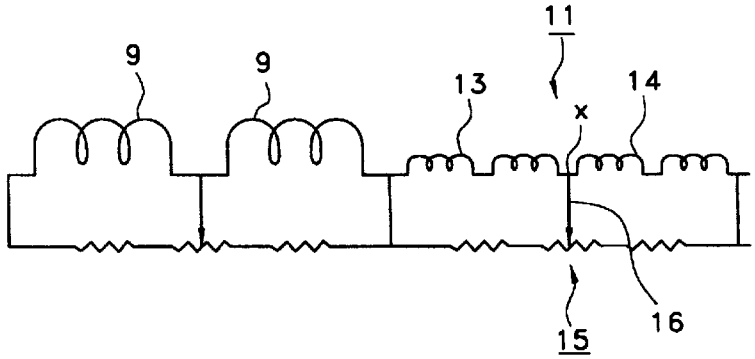
FIG. 3 is an equivalent circuit diagram illustrating a correction coil for correcting a YV aberration.

Referring to the equivalent coil in FIG. 3, the correction coils 11 for YV aberration arranged on the upper and lower portions of the neck 3 are in serial connection of a first coil 13 and a second coil 14 to generate magnetic fields in opposite directions. The phase of the connection point X between the first coil 13 and the second coil 14 is controllable as a variable resistor 15 when the connection point X is connected to an intermediate tap 16 of the variable resistor 15.

To be specific, the correction coils 11 for correcting the YV aberration are composed of a series of coils wound in duplicate around a single core. One of the duplicate coils is the first coil 13, and the other is the second coil 14. The first coil 13 is connected to the second 14 at the respective ends thereof.

Therefore, the balance of the current of the first coil 13 and the second coil 14 can be changed by either reversing the current up against the coils to generate magnetic fields in opposite directions or by adjusting the phase of the connection point X to generate a magnetic field in any one direction.

Meanwhile, the correction coils 11 for correcting the YV aberration are in serial connection to the vertical deflection coils 9. Correction flaps for correcting the XH aberration (not shown in the drawings) are mounted left and right sides of the neck so as to move toward the diametric direction of the tube.

FIG. 4 is a schematic view illustrating an operation of the correction coil for correcting the YV aberration. An operation of the correction coils 11 for correcting the YV aberration will now be described with reference to FIG. 4.

Figure 4A:
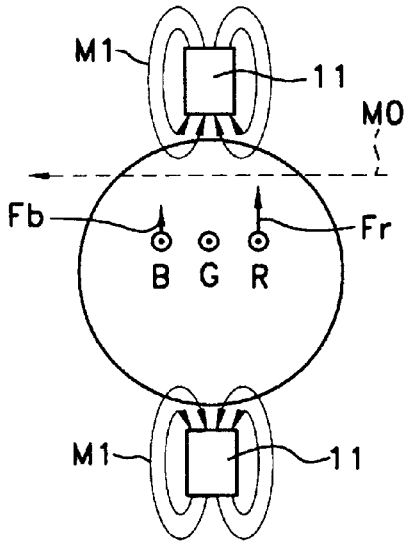
FIG. 4*a* is a schematic view of a correction coil for correcting a YV aberration of one direction in a state deflected upward.
Figure 4B:
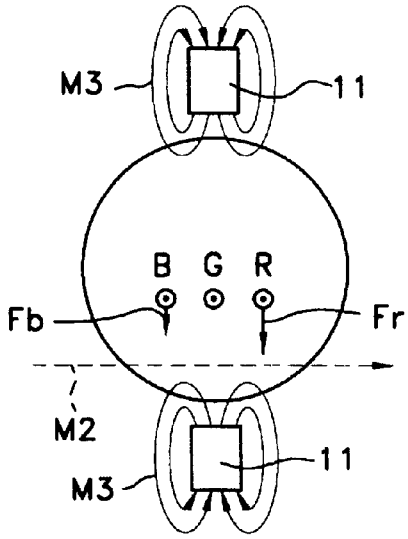
FIG. 4*b* is a schematic view of a correction coil for correcting the YV aberration of one direction in a state deflected downward.
Figure 5A:
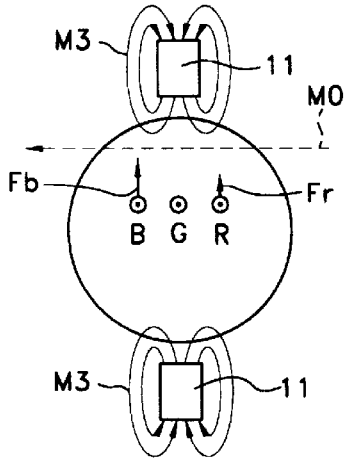
FIG. 5*a* is a schematic view of a correction coil for correcting the YV aberration in the other direction in a state of deflected upward.
Figure 5B:
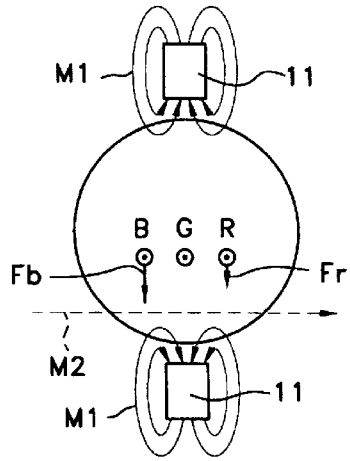
FIG. 5*b* is a schematic view of a correction coil for correcting the YV aberration in the other direction in a state of deflected downward.

FIGS. 4*a* and 5*a* show the states of deflecting the electron beams E scanned from each electron gun 6*b*, 6*g*, 6*r* upward of the display unit 4, while FIGS. 4*b* and 5*b* show the states of deflecting the electron beams E downward of the display unit 4. Here, B, G, R each of the electron beams E is assumed to be scanned toward a front direction I the drawings.

First to be described is a case of correcting the YV aberration caused such that the R image (indicated in a solid line in FIG. 6) is distorted inward of the screen and the B image (indicated in broken lines in FIG. 6) is distorted outward of the screen.

When the electron beams E are deflected upward, a magnetic field is generated from the right side to the left side (the M0 direction indicated by the dotted arrow line) as shown in FIG. 4*a* by the vertical deflection coils 9.

At this stage, if a magnetic field is generated from the external tip to the internal tip (the M1 direction indicated by the solid arrow line) of the correction coils 11 for correcting the YV aberration by adjusting the variable resistor 15 of the correction coils 11 for correcting the YV aberration, the magnetic field M0 generated by the vertical deflection coils 9 overlaps the magnetic field M1 generated by the correction coils 11 for correcting the YV aberration. As a consequence, the magnetic field is reinforced from the right side to the left side of the electron beam R, while the magnetic field is weakened from the right side to the left side of the electron beam B.

Here, the force Fr laid on the electron beam R becomes greater than the force Fb laid on the electron beam B. Therefore, the side of the electron beam R is more deflected upward.

On the other hand, when the electron beams E are deflected downward, a magnetic field is generated from the left side to the right side (the M2 direction indicated by the dotted arrow line) as shown in FIG. 4*b* by the vertical deflection coils 9.

At this stage, if a magnetic field is generated from the internal tip to the external tip (the M3 direction indicated by the solid arrow line) of the correction coils 11 for correcting the YV aberration by adjusting the variable resistor 15 of the correction coils 11 for correcting the YV aberration, the magnetic field M2 generated by the vertical deflection coils 9 overlaps the magnetic field M3 generated by the correction coils 11 for correcting the YV aberration. As a consequence, the magnetic field is reinforced from the left side to the right side of the electron beam R, while the magnetic field is weakened from the left side to the right side of the electron beam B.

Here, the force Fr laid on the electron beam R becomes greater than the force Fb laid on the electron beam B.

Therefore, the side of the electron beam R is more deflected downward.

Figure 6:
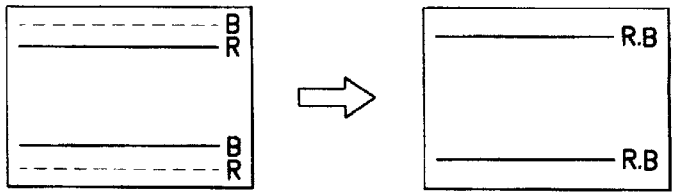
FIG. 6 is a schematic view illustrating the YV aberration corresponding to FIG. 4.

As a result, the YV aberration caused such that the R image is distorted inward of the screen and the B image is distorted outward of the screen, as shown on the left side of FIG. 6, can be corrected by adjusting the variable resistor 15 so that the magnetic field M1 is generated from the external tip to the internal tip of the correction coils 11 for correcting the YV aberration when the electron beams E are deflected upward as shown in FIG. 4*a* and that the magnetic field M3 is generated from the internal tip to the external tip of the correction coils 11 for correcting the YV aberration when the electron beams E are deflected downward as shown in FIG. 4*b*.

The following is a description of correcting the YV aberration caused such that the B image (indicated by broken lines in FIG. 7) is distorted inward of the screen while the R image (indicated by a solid line in FIG. 7) is distorted outward of the screen.

As in the case described above, when the electron beams E are deflected upward, a magnetic field M0 is generated from the right side to the left side as shown in FIG. 5*a* by the vertical deflection coils 9.

At this stage, on the contrary of the case in FIG. 4*a*, if a magnetic field M3 is generated from the internal tip to the external tip of the correction coils 11 for correcting the YV aberration by adjusting the variable resistor 15 of the correction coils 11 for correcting the YV aberration, the magnetic field is reinforced from the right side to the left side of the electron beam B, while the magnetic field is weakened from the right side to the left side of the electron beam R.

Here, the force Fb laid on the electron beam B becomes greater than the force Fr laid on the electron beam R. Therefore, the side of the electron beam B is more deflected upward.

On the other hand, when the electron beams E are deflected downward, a magnetic field M2 is generated from the left side to the right side as shown in FIG. 5*b* by the vertical deflection coils 9.

At this stage on the contrary to FIG. 4*b*, if a magnetic field M1 is generated from the external tip to the internal tip of the correction coils 11 for correcting the YV aberration, the magnetic field is reinforced from the left side to the right side of the electron beam B, while the magnetic field is weakened from the left side to the right side of the electron beam R.

Here, the force Fb laid on the electron beam B becomes greater than the force Fr laid on the electron beam R. Therefore, the side of the electron beam B is more deflected downward.

Figure 7:
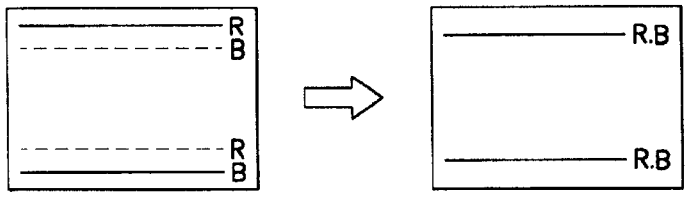
FIG. 7 is a schematic view illustrating the YV aberration corresponding to FIG. 5.
Figure 8:
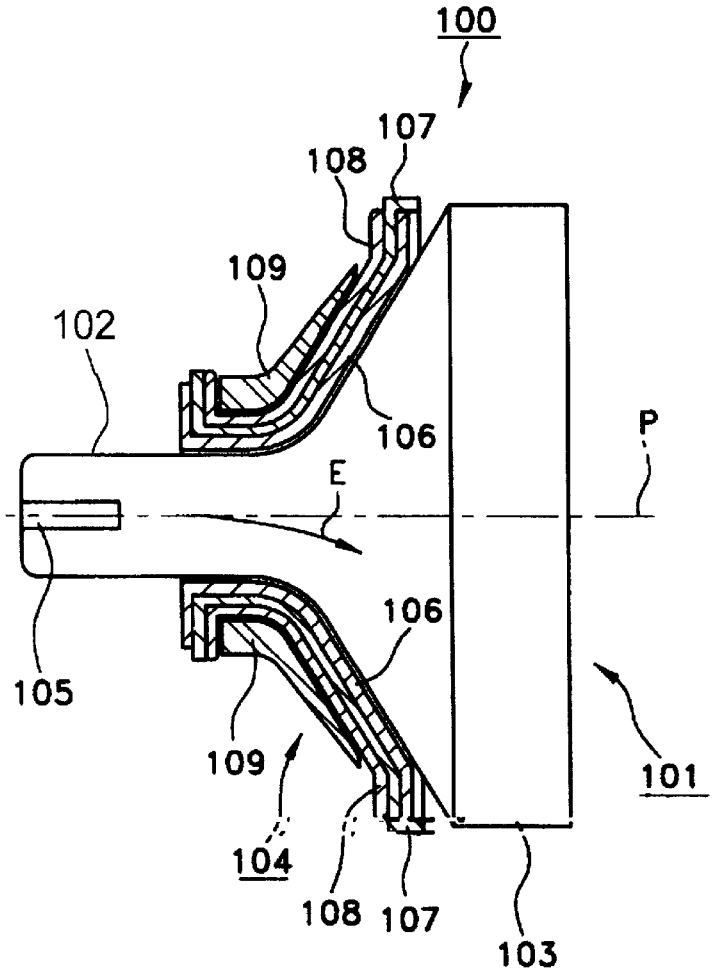
FIG. 8 (CONVENTIONAL ART)
FIG. 8 is a longitudinal section view illustrating a construction of a conventional color tube.
Figure 9:
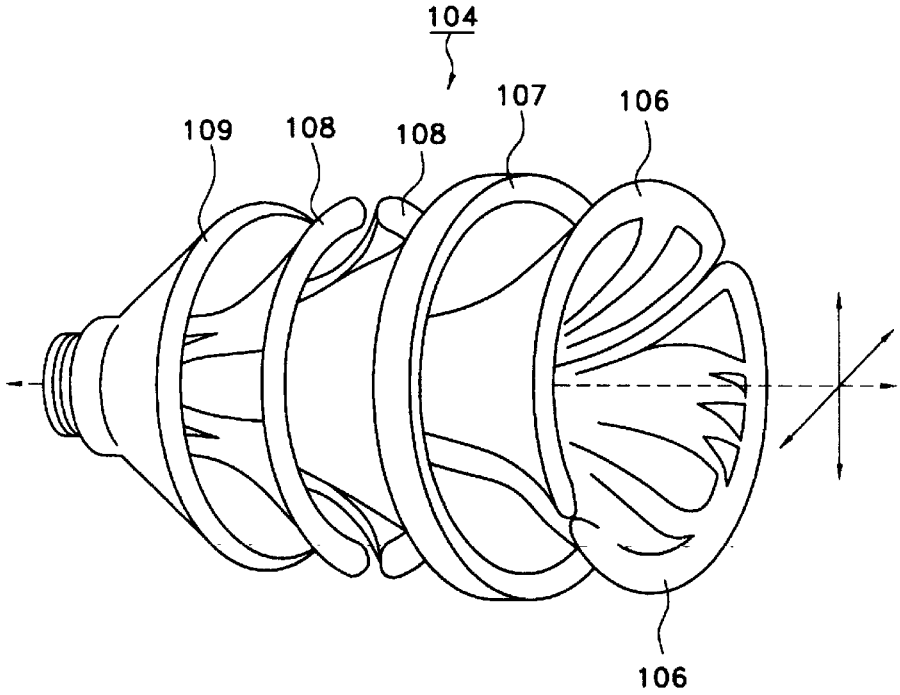
FIG. 9 (CONVENTIONAL ART)
FIG. 9 is a perspective view of each coil constituting a deflection yoke.
Figure 10:
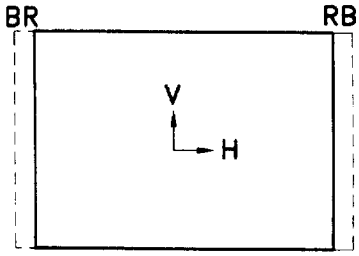
FIG. 10 (CONVENTIONAL ART)
FIG. 10 is a diagram of an XH aberration to illustrate a chromatic aberration.
Figure 11:
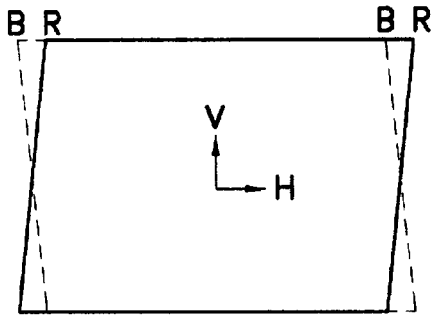
FIG. 11 (CONVENTIONAL ART)
FIG. 11 is a diagram of a YH cross to illustrate the chromatic aberration.
Figure 12:
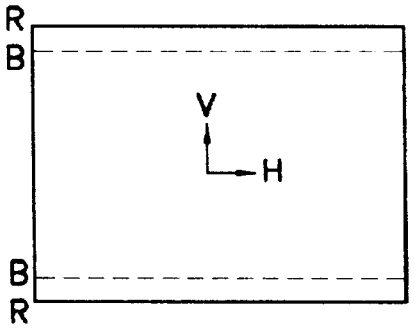
FIG. 12 (CONVENTIONAL ART)
FIG. 12 is a diagram of a YV aberration to illustrate the chromatic aberration.

As a result, the YV aberration caused such that the B image is distorted inward of the screen and the R image is distorted outward of the screen, as shown in FIG. 7, can be corrected by adjusting the variable resistor 15 so that the magnetic field M3 is generated from the internal tip to the external tip of the correction coils 11 for correcting the YV aberration when the electron beams E are deflected upward as shown in FIG. 5*a* and that the magnetic field M1 is generated from the external tip to the internal tip of the correction coils 11 for correcting the YV aberration when the electron beams E are deflected downward as shown in FIG. 5*b*.

Thus, according to the deflection yoke 5 constructed as described above, the bi-directional YV aberration can be corrected by merely adjusting the variable resistor 15 of the correction coils 11 for correcting the YV aberration. Since there is no need to change the current of the vertical deflection coils per se, laster is not deformed, either.

Furthermore, the correction coils 11 for correcting the YV aberration that face each other in a vertical direction outside of the neck 3 do not interrupt the correction flaps for correcting the XH aberration installed in a horizontal direction at the left and right sides of the neck 3. Therefore, the XH aberration can also be sufficiently corrected.

According to the above embodiment, a deflection yoke that can correct the bi-directional YV aberration with a simple construction can also be provided in addition to correction of the XH aberration.

Moreover, the deflection yoke 5 according to the above embodiment comprises central beam correction coils 12 so as to correct aberration of the G electron beam as well as to utilize internal space of the central beam correction coils 12 and to install the correction coil 11 for correcting the YV aberration. Therefore, the size of the deflection yoke can become thinner.

Furthermore, the deflection yoke 5 according to the above embodiment serves to correct a variety of chromatic aberrations in a wide range with a simple construction, thereby providing a color tube of a high quality.

Meanwhile, although size of the correction coil for correcting the YV aberration can be smaller by winding the coils in duplicate around a single coil according to the embodiment described above, it is also possible to construct the magnetic field generation coil of an opposite direction to be wound in duplicate toward the diametric direction of the tube unless the size of the system is critical.

Also, although the present invention employed a variable resistor as means for adjusting balance of the current of the first coil constituting the correction coil for correcting the YV aberration, it is also possible to supply independent voltage to each coil and adjust the supplied voltage on an individual level without employing the variable resistor.

The present invention also employed a central beam correction coil. However, it is possible to adjust the position of the central beam from the main body of the deflection coil. Also, the bend-type coil employed for the deflection yoke in the present invention can be replaced by a bendless-type coil.

As described above, the electron beam deflection system according to the present invention has an advantage of correcting the bi-directional YV aberration by a mere adjustment of the magnetic field of the correction coil of the YV aberration composed of a pair of coils facing each other in a vertical direction. Since there is no need to change the current of the vertical deflection coils per se, laster is not deformed, either.

Furthermore, the correction coil for correcting the YV aberration does not positionally interrupt the correction flaps for correcting the XH aberration, the XH aberration can also be sufficiently adjusted.

Thus, the electron beam deflection system according to the present invention has an effect of providing a color tube of high quality with its capability of correcting a variety of chromatic aberrations in a wide range with a simple construction.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An electron beam deflection system positioned outside of a main body of a color tube having a neck, inside of which electron beams are arranged in a horizontal direction, and a display unit extended from the neck in its diameter for displaying images by means of electron beams scanned from the electron beams and comprising:

a pair of horizontal deflection coils arranged to face each other in a vertical direction;

a pair of vertical deflection coils arranged to face each other in a vertical direction;

a pair of vertical deflection coils arranged to face each other in a vertical direction;

a pair of coils arranged to face each other in a vertical direction outside of the neck with the neck between them, each of the coils including a correction coil in a diametric direction of the neck for generating a magnetic field in an opposite direction to the direction of the other coil for correcting a YV aberration.

2. The electron beam deflection system of claim 1, wherein said electron beam deflection system is positioned outside of a main body of a color tube having a neck, inside of which electron beams are arranged in a horizontal direction, and a display unit extended from the neck in its diameter for displaying images by means of electron beams scanned from the electron beams.

3. The electron beam deflection system of claim 2, wherein the color tube comprises the electron beam deflection system and the main body of the color tube.

4. The electron beam deflection system of claims 1, wherein the color tube comprises the electron beam deflection system and the main body of the color tube.

5. An electron beam deflection system comprising:

a pair of horizontal deflection coils arranged to face each other in a vertical direction;

a pair of vertical deflection coils arranged to face each other in a horizontal direction; and a pair of coils arranged to face each other in a vertical direction outside of the neck with the neck between them, each of the coils including a correction coil in a diametric direction of the neck for generating a magnetic field in an opposite direction to the direction of the other coil for correcting a YV aberration.

6. An electron beam deflection system positioned outside of a main body of a color tube having a neck, inside of which electron beams are arranged in a horizontal direction, and a display unit extended from the neck in its diameter for displaying images by means of electron beams scanned from the electron beams and comprising:

a pair of horizontal deflection coils arranged to face with each other in a vertical direction;

a pair of vertical deflection coils arranged to face with each other in a vertical direction;

a pair of vertical deflection coils arranged to face with each other in a vertical direction;

a pair of coils arranged to face with each other in a vertical direction outside of the neck, each of the coils including a correction coil in a diametric direction of the neck for generating a magnetic field in an opposite direction to the direction of correcting a YV aberration;

wherein each coil constituting the correction coil is serially connected for generating magnetic fields in opposite directions and the phase of the connecting point between the first coil and the second coil is controlled by a variable.

7. The electron beam deflection system of claim 6, wherein the first coil and the second coil constituting the correction coil comprise one or more coils on a core, and are serially connected at the respective ends thereof.

8. The electron beam deflection system of claim 7, characterized by a pair of central beam correction coils for correcting positional aberration of the electron beam scanned from a central electron gun among the electron guns, each correction coil comprising the first coil and the second coil being provided inside of each central beam correction coil.

9. The electron beam deflection system of claim 8, wherein the color tube comprises the electron beam deflection system and the main body of the color tube.

10. The electron beam deflection system of claims 7, wherein the color tube comprises the electron beam deflection system and the main body of the color tube.

11. The electron beam deflection system of claims 6, wherein the color tube comprises the electron beam deflection system and the main body of the color tube.

12. An electron beam deflection system comprising:

a pair of horizontal deflection coils arranged to face with each other in a vertical direction;

a pair of vertical deflection coils arranged to face with each other in a horizontal direction; and a pair of coils arranged to face with each other in a vertical direction outside of the neck, each of the coils including a correction coil in a diametric direction of the neck for generating a magnetic field in an opposite direction to the direction of correcting a YV aberration;

wherein each coil constituting the correction coil is serially connected for generating magnetic fields in opposite directions, and the phase of the connecting point between the first coil and the second coil is controlled by a variable resistor.

13. The electron beam deflection system of claim 12, wherein the first coil and the second coil constituting the correction coil comprise one or more coils on a core, and are serially connected at the respective ends thereof.

14. The electron beam deflection system of claim 13, characterized by a pair of central beam correction coils for correcting positional aberration of the electron beam scanned from a central electron gun among the electron guns, each correction coil comprising the first coil and the second coil being provided inside of each central beam correction coil.

15. The electron beam deflection system of claim 14, wherein the color tube comprises the electron beam deflection system and the main body of the color tube.

16. The electron beam deflection system of claim 13, wherein the color tube comprises the electron beam deflection system and the main body of the color tube.

17. The electron beam deflection system of claim 12, wherein the color tube comprises the electron beam deflection system and the main body of the color tube.

* * * * *